United States Patent [19]

Behringer et al.

[11] Patent Number: 4,652,349

[45] Date of Patent: Mar. 24, 1987

[54] BATHS FOR THE ELECTRODEPOSITION OF TIN-GRAPHITE OR TIN/LEAD-GRAPHITE LAYERS

[75] Inventors: Georg Behringer, Rosstal; Klaus Otto, Nuremberg, both of Fed. Rep. of Germany

[73] Assignee: Siemens Aktiengesellschaft, Berlin and Munich, Fed. Rep. of Germany

[21] Appl. No.: 842,980

[22] Filed: Mar. 24, 1986

[30] Foreign Application Priority Data

Mar. 29, 1985 [DE] Fed. Rep. of Germany ..... 3511621

[51] Int. Cl.[4] ..... C25D 3/30; C25D 3/32; C25D 3/60

[52] U.S. Cl. ..... 204/44.4; 204/54.1

[58] Field of Search ..... 204/54 R, 44.4, 16

[56] References Cited

U.S. PATENT DOCUMENTS 2,489,523 11/1949 Clifton ..... 204/44.4

FOREIGN PATENT DOCUMENTS 2413402 10/1975 Fed. Rep. of Germany ..... 204/38.1
2634128 2/1978 Fed. Rep. of Germany ..... 204/49
2543082 6/1979 Fed. Rep. of Germany ..... 204/46.1
1435559 3/1966 France ..... 204/54 R
1224166 3/1971 United Kingdom ..... 204/48
1236954 6/1971 United Kingdom ..... 204/16
1265472 3/1972 United Kingdom ..... 204/48
1375541 11/1974 United Kingdom ..... 204/16

*Primary Examiner*—G. L. Kaplan
*Attorney, Agent, or Firm*—John Francis Moran

[57] ABSTRACT

For the production of tin-graphite or respectively tin/-lead-graphite layers, it is known to electrodeposit a tin or respectively tin/lead layer and to mechanically incorporate graphite in the boundary zone. In accordance with the method of the invention, the tin-graphite or tin/lead-graphite layer is produced electrolytically in a single operation, operating with an electroplating bath on a strongly acid basis in which graphite powder is dispersed by means of an acid-stable wetting agent, and at temperatures of up to 35° C. In the respective electroplating bath the solution has a pH value equal to or less than 2 and contains in acid-stable wetting agent for graphite.

11 Claims, No Drawings

BATHS FOR THE ELECTRODEPOSITION OF TIN-GRAPHITE OR TIN/LEAD-GRAPHITE LAYERS

BACKGROUND OF THE INVENTION

This invention relates to a method for the production of tin-graphite or tin/lead-graphite layers in which at least a layer of tin is deposited electrolytically. More particularly, the invention relates also to a bath for the electrodeposition of such dispersion coatings from an aqueous solution of tin(II) and possibly lead(II) salts.

For the fabrication of multiple plug contact strips, there have been used until now predominantly precious-metal coated contact pins or knives and contact jacks, which are typically applied exclusively by electroplating. To extend the useful life in these applications, it is conventional practice to provide graphite inclusions in the precious metal coatings. For example from German patent document No. DE-PS 25 42 082, and corresponding British patent document No. GB-PS 15 34 429, a cyanide silver electrolyte and a process for the electrodeposition of silver-graphite dispersion coatings are disclosed to make electrical contact wherein the graphite serves as a solid lubricant.

For some time those skilled in the art have endeavored to replace the precious metal layers for the above stated contacts by tin or tin/lead layers. Tin layers may be applied either by hot tinplating or by means of electrolytic baths. From German patent document No. DE-OS 24 13 402, gliding tin layers for electric slide contacts on plug elements are disclosed, where the tin or tin/lead layers, in particular if applied by electroplating, are incorporated in the boundary zone of the surface by a process known as ball polishing with the addition of substances which promote sliding, such as graphite powder, which at the same time promotes work-hardening.

In the prior art, therefore, the inclusion of the graphite in the tin layer occurs only mechanically in the boundary zone to a depth of about 0.5 μm, and this requires a separate additional operation. Here the shape of the parts to be treated is of importance; optimum distribution on all boundary areas of the contact cannot be achieved.

It is an object of this invention which is to be described to provide an improved method for the application of layers on a tin-graphite or respectively tin/lead-graphite basis and the respective means.

SUMMARY OF THE INVENTION

In accordance with the invention, the problem is solved in that the tin-graphite or tin/lead-graphite layer is produced electrolytically as a dispersion coating in a single operation, this being done with an electroplating bath on a strongly acid basis in which graphite powder is dispersed by means of an acid-stable wetting agent, and at temperatures of less than 35° C. Advantageously the electrodeposition of the tin-graphite coating occurs in a range of current densities of 1 to 15 A/dm$_2$.

To perform the method in accordance with the principles of the invention, a bath for the electrodeposition of tin-graphite dispersion coatings from an aqueous solution of tin(II) and possibly lead(II) salts is used in which the solution has a pH value of 2 or below and contains an acid-stable wetting agent. Advantageously the wetting agent is an organic substance which does not tend to foam, or only in a controlled manner. Such wetting agents may be one or more of the substances from the group of phenol and dibutyl aniline, gelatin and cresol, cresol-sulfonic acid and 2-methyl-pentyl sulfate, dibutyl-sodium naphthalene sulfonate or sodium lauryl sulfate and sodium xanthogenate. The graphite powder dispersed in the wetting agent has preferably a grain size distribution of less than one and up to five microns (<-5 μm) wherein 70% of the graphite particles are smaller than 1 micron.

In connection with the invention suitable wetting agents were found which are able to disperse the fine graphite grains and at the same time to ensure their inclusion in the electrodeposited tin or tin/lead layers in sufficient degree. The electropolating baths mixed with the suited wetting agents are preferably employed at room temperature or at temperatures of 35° C. and below.

From German patent document No. DE-PS 26 34 128, a bath and a method for the electrodeposition of nickel-graphite dispersion coatings from an aqueous solution of nickel sulfamate was indeed known which operates on an acid basis and contains a wetting agent suitable for acid nickel baths. However, nickel requires prerequisites that are different than for those of tin. It had heretofore been assumed that tin-graphite based layers cannot be produced by electroplating.

Due to the invention, the abrasion resistance in electrodeposited tin and tin/lead layers, which may also have a small antimony content that increases the hardness of the coating, can be improved considerably. The necessary plugging force is thereby reduced, despite a high contact pressure. Specifically it has been proven that with the electrolytically produced dispersion coatings of tin-graphite or respectively tin/lead graphite combinations the abrasion resistance is increased 10 to 25 times compared with the previously known tin or tin/lead combination layers.

Other details and advantages of the invention will become evident from the following description of illustrative embodiments.

In the various examples, the metallic contacts are first subjected to a pretreatment common in electroplating and are then coated in one of the electrolytes of the composition indicated below with a tin-graphite or tin/lead-graphite dispersion coating.

EXAMPLE I

| | |
|---|---|
| Tin sulfate Sn—II—$SO_4$ corresponding to | 26 g Sn/lt |
| Sulfuric Acid (D = 1.84) $H_2SO_4$ | 140 g/lt |
| Phenol $C_6H_5OH$ | 5 g/lt |
| Dibutyl aniline $C_6H_5N(C_4H_9)_2$ | 1 g/lt |
| Graphite, grain size <1-5 μm | 100 g/lt |
| Temperature (room temperature) | 22° C. |
| | pH approx. 0.5 |
| Current density | 1.5 A/dm$^2$ |
| Layer thickness | 20 μm |

The deposited tin layer contained 1.6% by weight graphite. The abrasion resistance increased tenfold or times.

EXAMPLE II

| | |
|---|---|
| Tin fluoborate Sn—II—$(BF_4)_2$ corresponding to | 66 g Sn/lt |
| Borofluoric acid H $BF_4$ | 120 g/lt |
| Boric Acid $H_3BO_3$ | 20 g/lt |
| Gelatin (protein-like natural product) | 4 g/lt |
| Cresol $CH_3C_6H_4OH$ | 6 g/lt |

-continued

| | |
|---|---|
| Graphite, grain size ≦1-5 μm | 100 g/lt |
| Temperature (room temperature) | 22° C. |
| | pH <2 |
| Current density | 10 A/dm$^2$ |
| Layer thickness | 20 μm |

The deposited layer contained 2% graphite by weight. The abrasion resistance increased eighteen times.

EXAMPLE III

| | |
|---|---|
| Tin methane sulfonate Sn—II—$(CH_3OSO_2)_2$ | 70 g/lt Sn |
| Methane sulfonic acid $CH_3OSO_2H$ | 300 g/lt |
| Cresol sulfonic acid $CH_3C_6H_4OSO_2H$ | 6 g/lt |
| 2-Methyl-pentyl sulfate | 8 g/lt |
| Graphite, grain size <1-5 μm | 100 g/lt |
| Temperature (room temperature) | 22° C. |
| | pH <1 |
| Current density | 10 A/dm$^2$ |
| Layer thickness | 20 μm |

The deposited tin layer contained 1.8% carbon by weight. The abrasion resistance compared with a pure tin layer was increased twenty times.

EXAMPLE IV

| | |
|---|---|
| Tin methacrylic sulfonate Sn—II—$(C_4H_3O_2SO_2)_2$ corresponding to | 70 g Sn/lt |
| Lead methacrylic sulfonate Pb—II—$(C_4H_3O_2SO_2)$ corresponding to | 6 g Pb/lt |
| Methacrylic sulfonic acid $C_4H_3O_2SO_2H$ | 110 g/lt |
| Potassium-antimony-III oxide tartrate $K(SbO)O_4H_4O_6H$ | 3 g/lt |
| Dibutyl-sodium-naphthalene sulfonate $C_{10}H_5(CH_4H_9)_2SO_2Na$ | 0.5 g/lt |
| Graphite, grain size <1-5 μm | 100 g/lt |
| Temperature (room temperature) | 22° C. |
| | pH approx. 1 |
| Current density | 10 A/dm$^2$ |
| Layer thickness | 20 μm |

The deposited tin/lead layer (90/10) contained 1.8% graphite by weight and 1% antimony by weight. The abrasion resistance is increased twenty-five times compared to layers of pure tin/lead.

EXAMPLE V

| | |
|---|---|
| Tin methane sulfonate Sn—II—$(CH_3OSO_2)_2$ corresponding to | 9 g Sn/lt |
| Lead methane sulfonate Pb—II—$(CH_3OSO_2)_2$ corresponding to | 4.5 g Pb/lt |
| Methane sulfonic acid $CH_3OSO_2H$ | 250 g/lt |
| Potassium-antimony-III-oxide tartrate $K(SbO)C_4H_4O_6$ | 3 g/lt |
| Sodium lauryl sulfate $C_{12}H_{25}OSO_2Na$ | 0.5 g/lt |
| Sodium xanthogenate $C_3H_5S_2ONa$ | 0.1 g/lt |
| Graphite, grain size <1-5 μm | 60 g/lt |
| Temperature (room temperature) | 22° C. |
| | pH <1 |
| Current density | 5 A/dm$^2$ |
| Layer thickness | 20 μm |

The deposited tin/lead layer (60/40) contained 1% by weight graphite and 1% by wt. antimony. The abrasion resistance rises 10 fold as compared with a pure tin/lead layer.

There has thus been shown and described a novel method for electrolytically plating metal and graphite in a single operation which fulfills all the objects and advantages sought therefor. Many changes, modifications, variations and other uses and applications of the subject invention will, however, become apparent to those skilled in the art after considering this specification which disclose preferred embodiments thereof. All such changes, modifications, variations and other uses and applications which do not depart from the spirit and scope of the invention are deemed to be covered by the invention which is limited only by the claims which follow.

We claim:

1. A bath for the electrodeposition of tin-graphite dispersion coatings from an aqueous solution of tin(II) and possibly lead(II) salts, characterized in that the solution has a pH value ≦2 and contains an acid-stable wetting agent for graphite, and the bath includes tin sulfate corresponding to 26 g Sn/lt, 140 g/lt sulfuric acid, 5 g/lt phenol, 1 g/lt dibutyl aniline and 100 g/lt graphite.

2. A bath according to claim 1, wherein the wetting agent is an organic substance which has a controlled foaming characteristic.

3. A bath for the electrodeposition of tin-graphite dispersion coatings from an aqueous solution of tin(II) and possibly lead(II) salts, characterized in that the solution has a pH value =2 and contains an acid-stable wetting agent for graphite, and the path includes tin fluoborate corresponding to 66 g Sn/lt, 120 g/lt borofluoric acid, 20 g/lt boric acid, 4 g/lt gelatin, 6 g/lt cresol, and 100 g/lt graphite.

4. A bath according to claim 3, wherein the wetting agent is an organic substance which has a controlled foaming characteristic.

5. A bath for the electrodeposition of tin-graphite dispersion coatings from an aqueous solution of tin(II) and possibly lead(II) salts, characterized in that the solution has a pH value ≦2 and contains an acid-stable wetting agent for graphite, and the bath includes tin(II) methane sulfonate corresponding to 70 g Sn/lt, 300 g/lt methane sulfonic acid, 6 g/lt cresol sulfonic acid, 8 g/lt 2-methyl-pentyl sulfate, and 100 g/lt graphite.

6. A bath according to claim 5, wherein the wetting agent is an organic substance which has a controlled foaming characteristic.

7. A bath for the electrodeposition of tin-graphite dispersion coatings from an aqueous solution of tin(II) and possibly lead(II) salts, characterized in that the solution has a pH value ≦2 and contains an acid-stable wetting agent for graphite, and the bath includes tin(II) methacrylic sulfonate corresponding to 70 g Sn/lt, lead(II) methacrylic sulfonate corresponding to 6 g Pb/lt, 110 g/lt methacrylic sulfonic acid, 3 g/lt potassium-antimony(III) oxide tartrate, 0.5 g/lt dibutyl-sodium naphthalene sulfonate and 100 g/lt graphite.

8. A bath according to claim 7, wherein the wetting agent is an organic substance which has a controlled foaming characteristic.

9. A path for the electrodeposition of tin-graphite dispersion coatings from an aqueous solution of tin(II) and possibly lead(II) salts, characterized in that the solution has a pH value ≦2 and contains an acid-stable wetting agent for graphite, and the bath includes tin(II) methane sulfonate corresponding to 9 g Sn/lt, lead(II) methane sulfonate corresponding to 4.5 g Pb/lt, 250 g/lt methane sulfonic acid, 0.5 g/lt sodium lauryl sulfate, 0.1 g/lt sodium xanthogenate and 60 g/lt graphite.

10. A bath according to claim 9, wherein the wetting agent is an organic substance which has a controlled foaming characteristic.

11. A bath for the electrodeposition of tin-graphite dispersion coatings from an aqueous solution of tin(II) and possibly lead(II) salts, characterized in that the solution has a pH value ≦2 and contains an acid-stable wetting agent for graphite, and the graphite is in a powder form having a grain size distribution less than one and up to five microns, and the bath includes tin sulfate corresponding to 26 g Sn/lt, 140 sulfuric acid, 5 g/lt phenol, 1 g/lt dibutyl aniline and 100 g/lt graphite.

* * * * *